US007862392B1

(12) United States Patent
Chen

(10) Patent No.: US 7,862,392 B1
(45) Date of Patent: Jan. 4, 2011

(54) SLEEVE-TYPE WIRE CONNECTOR

(75) Inventor: Yung-Chou Chen, Ta Li (TW)

(73) Assignee: Uta Auto Industrial Co., Ltd., Ta Li (TW)

( * ) Notice: Subject to any disclaimer, the term of this patent is extended or adjusted under 35 U.S.C. 154(b) by 0 days.

(21) Appl. No.: 12/567,796

(22) Filed: Sep. 27, 2009

(51) Int. Cl.
*H01R 4/10* (2006.01)
*H01R 4/00* (2006.01)

(52) U.S. Cl. ..... 439/880; 174/84 R; 174/84 C

(58) Field of Classification Search ..... 439/880; 174/84 R, 84 C
See application file for complete search history.

(56) References Cited

U.S. PATENT DOCUMENTS 3,512,123 A * 5/1970 Costello et al. ..... 439/730
5,167,066 A 12/1992 McEnroe
7,683,260 B2 * 3/2010 Bertini et al. ..... 174/84 R
7,767,909 B2 * 8/2010 Krabs et al. ..... 174/84 R
2010/0059275 A1 * 3/2010 Steele et al. ..... 174/84 R

FOREIGN PATENT DOCUMENTS

TW 419156 1/2001
TW 456076 9/2001

* cited by examiner

*Primary Examiner*—Hien Vu
(74) *Attorney, Agent, or Firm*—Wang Law Firm; Li K. Wang

(57) ABSTRACT

A sleeve-type wire connector comprises: a first tube having a first opening end and a connecting end, with a first guiding surface in the first opening end that can retract toward the connecting end thereof; a copper sleeve in the connecting end of the first tube; and a second tube having a connecting end corresponding to the connecting end of the first tube and a second opening end, with a second guiding surface in the second opening end that can retract toward the connecting end thereof.

2 Claims, 2 Drawing Sheets

SLEEVE-TYPE WIRE CONNECTOR

BACKGROUND OF THE INVENTION

1. Field of Invention

The invention relates to a connector and, in particular, to a sleeve-type wire connector that can effectively facilitate smooth connection of wire connecting ends and ensure electrical conductivity thereof.

2. Related Art

Users often need to connect two wires in order to extend the reach. Normally, one uses a wire connector to connect two wires. However, the conventional wire connector, as shown in FIG. 4, is basically a tube with two opposite openings integrally formed by a plastic injector. A body part 62 with a smaller diameter is formed between the two openings 61. Afterwards, a copper sleeve 63 is then inserted into the body part 62 to form a wire connector.

However, the conventional wire connector has a roughly vertical ladder section 64 at the junction between the openings 61 and the inner surface of the copper sleeve 63. The ladder section 64 is an obstacle for the core lines 66 of the wires 65 to insert. Therefore, the connection may not be sufficiently smooth. Moreover, for a wire 65 comprised of multiple core lines 66, the outermost core lines 66 are likely bent by the ladder section 64. This in the end affects the electrical power of the system.

Besides, it is more difficult for an injection molding machine to make both ends of the connector expand outward. The involved design is more complicated and costly. Also, due to the complication, the production yield cannot be effectively increased.

SUMMARY OF THE INVENTION

An objective of the invention is to provide a sleeve-type wire connector that has a lower production cost but can effectively increase the smoothness of wire connections. It can increase the work efficiency, as well as ensure the electrical conductivity of the wires.

To achieve the above objective, the disclosed sleeve-type wire connector comprises:

a first tube having a first opening end that expands outward and a connecting end, with the inner surface of the first opening end being disposed annularly with a first guiding surface that retracts toward the connecting end thereof and a first stopping surface being formed at the junction between the first guiding surface and the inner surface of the connecting end;

a copper sleeve disposed in the connecting end of the first tube and engaged with the first stopping surface of the first tube by its one end; and a second tube having a mounting end corresponding to the connecting end of the first tube and a second opening end that expands outward, with the inner surface of the second opening end being disposed annularly with a second guiding surface that retracts toward the mounting end thereof and a second stopping surface being formed at the junction between the second guiding surface and the inner surface of the mounting end;

wherein the second stopping surface of the second tube urges against the other end of the copper sleeve when the mounting end of the second tube is mounted onto the connecting end of the first tube.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
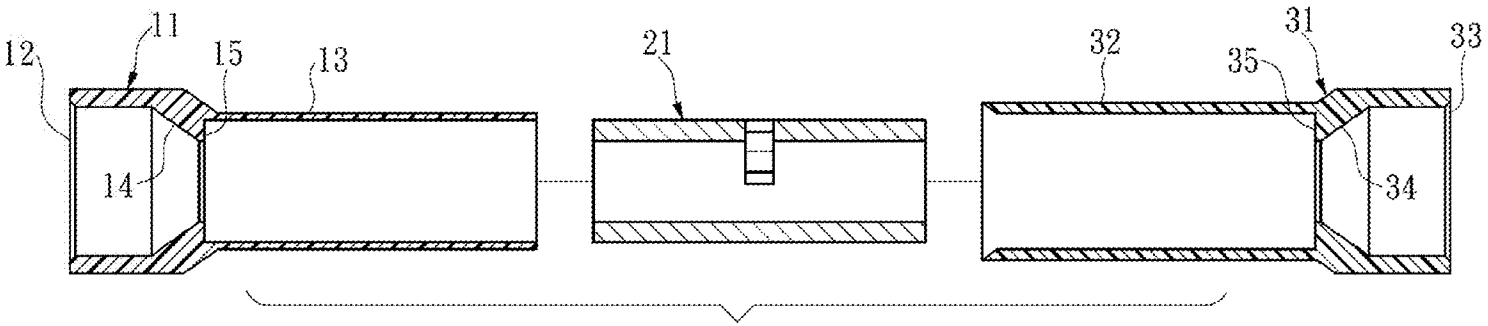
FIG. 1 is a schematic view of the disclosed structure.
Figure 2:
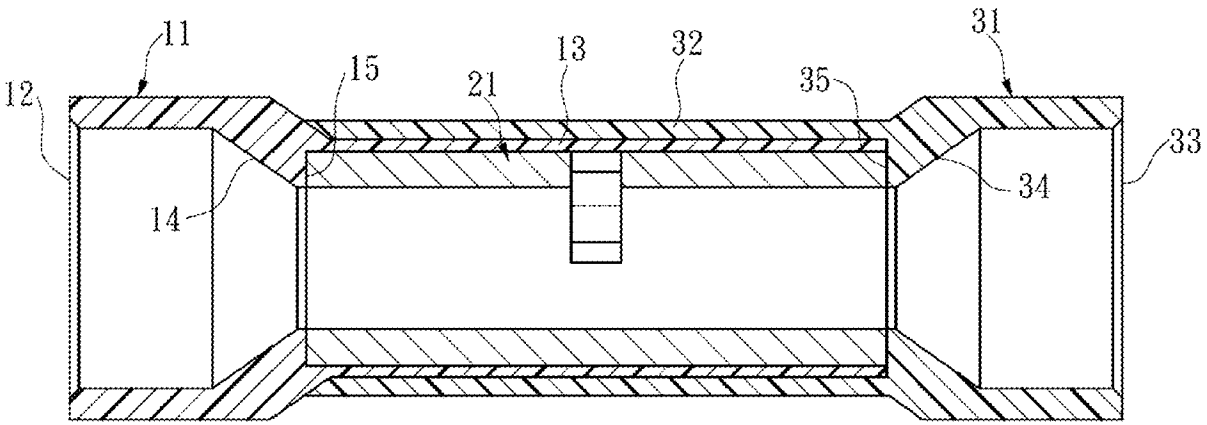
FIG. 2 is a schematic view of the invention after assembly.

Please refer to FIGS. 1 and 2 that show a sleeve-type wire connector according to the invention. It mainly consists of a first tube 11, a copper sleeve 21, and a second tube 31.

The first tube 11 is integrally formed by an injection molding machine to be a hollow pipe. Its one end is a first opening end 12 expanding outward, and its other end is a connecting end 13 in communication with the first opening end 12. The inner surface of the first opening end 12 is provided with a first guiding surface 14 that gradually shrinks toward the connecting end 13. A first stopping surface 15 is formed at the junction between the first guiding surface 14 and the inner surface of the connecting end 13.

The copper sleeve 21 is also a hollow tube, mounted in the connecting end 13 of the first tube 11. The outer surface of the copper sleeve 21 exactly attaches to the inner surface of the connecting end 13 of the first tube 11. When the copper sleeve 21 is accommodated in the connecting end 13 of the first tube 11, its one end urges against the first stopping surface 15 of the connecting end 13 of the first tube 11.

The second tube 31 is also a hollow tube, integrally formed by an injection molding machine. One end of the second tube 31 is formed with a mounting end 32 that can correspondingly mount onto the connecting end 13 of the first tube 11. The other end of the second tube 31 is formed with a second opening end 33 expanding outward. The inner surface of the second opening 33 of the second tube 31 is formed with a second guiding surface 34 that gradually reduces toward the mounting end 32. A second stopping surface 35 is formed at the junction between the second guiding surface 34 and the inner surface of the mounting end 32. When the mounting end 32 of the second tube 31 is mounted onto the connecting end 13 of the first tube 11, the inner surface of the mounting end 32 of the second tube 31 exactly attaches to the outer surface of the connecting end 13 of the first tube 11. Moreover, the second stopping surface 35 of the second tube 31 urges against the other end of the copper sleeve. This firmly fixes and limits the copper sleeve 21, preventing it from falling off.

When assembling the invention, one first directly inserts the copper sleeve 21 into the connecting end 13 of the first tube 11. Afterwards, the mounting end 32 of the second tube 31 is mounted onto the connecting end 13 of the first tube 11. This renders the disclosed sleeve-type wire connector.

Figure 3:
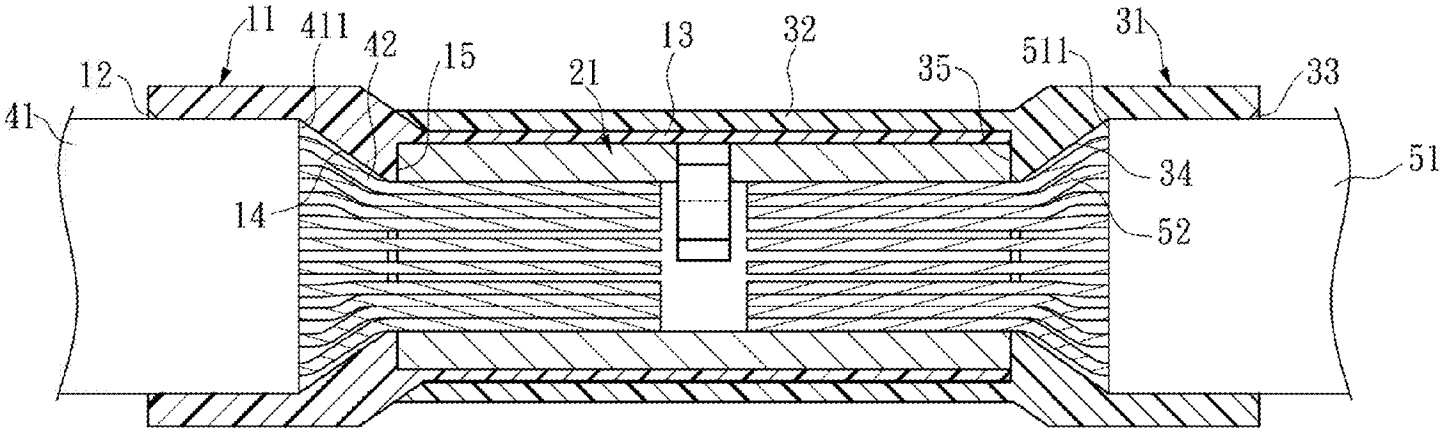
FIG. 3 is a schematic view of the invention in use.
Figure 4:
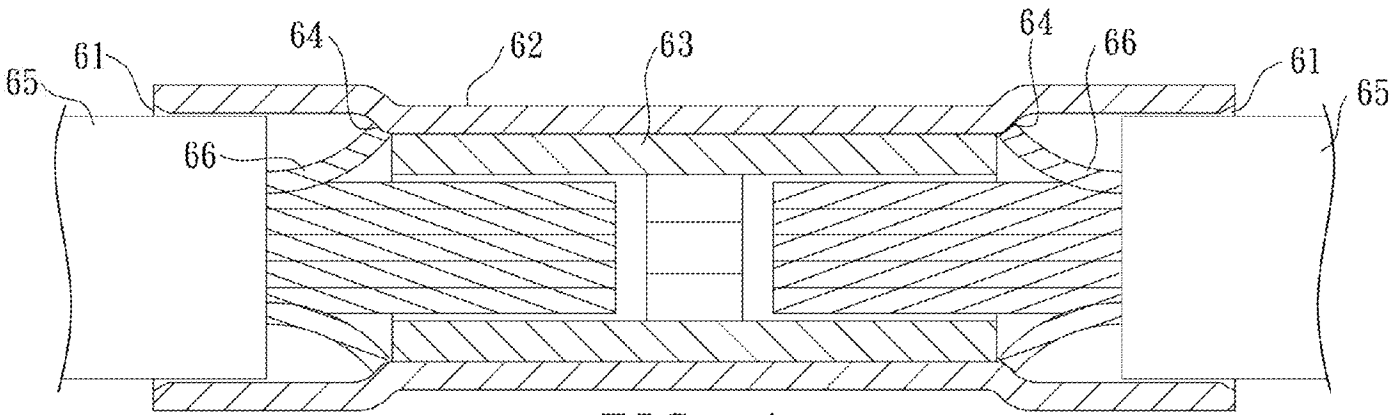
FIG. 4 PRIOR ART
FIG. 4 is a schematic view of a conventional wire connector in use.

Please refer to FIG. 3. When the invention is in use, one can insert two wires 41, 51 into the two opening ends 12, 33 of the first tube 11 and the second tube 31, respectively. In this case, the core lines 42, 52 of the wires 41, 51 are guided respectively by the first guiding surface 14 on the inner surface of the first tube 11 and the second guiding surface 34 on the inner surface of the second tube 31 into the copper sleeve 21 smoothly. Therefore, one does not encounter any difficulty when connecting to the two wires 41, 51. This therefore increases the work efficiency of the user. Later on, the user simply uses a pinch (not shown) to pinch the connected mounting end and the connecting end, fixing the core lines 42, 52 of the two wires 41, 51 in the copper sleeve 21 for conducting an electrical current.

While the guiding surfaces 14, 34 smoothly guide the core lines 42, 52 of the wires 41, 51 into the copper sleeve 21, the skins 411, 511 of the wires 41, 51 are blocked by the guiding surfaces 14, 34. That is, the large-diameter ends of the guiding surfaces 14, 34 exactly allow the insertion of the skins 411, 511. But the guiding surfaces 14, 34 shrinking toward the connecting end 13 and the mounting end 32 block the skins 411, 511 of the wires, now allowing only the core lines 42, 52 of the wires to enter. This ensures the stability of the electrical conductivity of the wires 41, 51 after the connection.

The disclosed sleeve-type wire connector has the following advantages:

1. The first tube and the second tube are integrally formed using an injection molding machine. They involve simple manufacturing processes and are suitable for mass production. Since the first tube and the second tube are connected by mounting, the assembly is simple and quick.

2. The first guiding surface of the first tube and the second guiding surface of the second tube in the invention smoothly guide the core lines of the wires into the copper sleeve. Therefore, one does not encounter any resistance when connecting the two wires. This easy assembly can effectively increase the work efficiency of the user.

3. The first guiding surface and the second guiding surface are delicately designed such that the wire skins are prevented from entering the copper sleeve, thereby ensuring the stability of electrical conductivity of the wires.

4. One end of the copper sleeve urges against the first stopping surface of the first tube. The second stopping surface of the second tube urges against the other end of the copper sleeve. Therefore, the copper sleeve is firmly fixed and limited so that it does not fall off.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A sleeve-type wire connector, comprising:

a first insulating tube having a first opening end that extends outwardly at one end and a connecting end at the other end thereof, with an inner surface of the first opening end being disposed annularly with a first guiding surface that reduces toward the connecting end thereof and an inner first stopping surface being formed at the junction between a rear end of the first guiding surface and a rear end of the inner surface of the connecting end;

a copper sleeve disposed in the connecting end of the first tube and engaged with the first stopping surface of a first tube at one end of the copper sleeve; and a second insulating tube having a mounting end at one end corresponding to the connecting end of the first tube and a second opening end at other end that extends outwardly, with the inner surface of the second opening end being disposed annularly with a second guiding surface that reduces toward the mounting end thereof and an inner second stopping surface being formed at the junction between a rear end of the second guiding surface and a rear end of the inner surface of the mounting end;

wherein the second stopping surface of the second tube urges against the other end of the copper sleeve when the connecting end of the second tube is mounted onto the connecting end of the first tube wherein the first insulating tube and the second insulating tube cover an entire length of the copper sleeve with the first insulating tube positioned in between the copper sleeve and the second insulating tube.

2. The sleeve-type wire connector of claim 1, wherein the outer surface of the copper sleeve attaches to the inner surface of the connecting end of the first tube and the inner surface of the mounting end of the second tube attaches to the outer surface of the connecting end of the first tube when the mounting end of the second tube is mounted onto the connecting end of the first tube.

* * * * *